US006068500A

United States Patent [19]

Kantner

[11] Patent Number: 6,068,500

[45] Date of Patent: May 30, 2000

[54] MULTI-CONTACT PC CARD AND HOST SYSTEM

[75] Inventor: Edward A. Kantner, Raleigh, N.C.

[73] Assignee: ITT Manufacturing Enterprises, Inc., Wilmington, Del.

[21] Appl. No.: 09/123,303

[22] Filed: Jul. 28, 1998

[51] Int. Cl.[7] ..... H01R 27/00

[52] U.S. Cl. ..... 439/218; 439/541.5; 439/946; 361/737

[58] Field of Search ..... 439/218, 64, 945, 439/946, 76.1, 541.5; 361/737, 684

[56] References Cited

U.S. PATENT DOCUMENTS

| | | | |
|---|---|---|---|
| 4,571,012 | 2/1986 | Bassler et al. | 439/101 |
| 4,623,211 | 11/1986 | Dambach et al. | 439/607 |
| 5,052,948 | 10/1991 | Hyzin | 439/607 |
| 5,288,247 | 2/1994 | Kaufman | 439/607 |
| 5,299,089 | 3/1994 | Lwee | 361/384 |
| 5,324,204 | 6/1994 | Lwee | 439/64 |
| 5,399,105 | 3/1995 | Kaufman et al. | 439/609 |
| 5,470,259 | 11/1995 | Kaufman et al. | 439/607 |
| 5,478,260 | 12/1995 | Kaufaman et al. | 439/609 |
| 5,490,791 | 2/1996 | Yamada et al. | 439/159 |
| 5,547,397 | 8/1996 | Hirai | 439/607 |
| 5,574,682 | 11/1996 | Shinohara | 439/684 |
| 5,591,047 | 1/1997 | Yamada et al. | 439/541.5 |
| 5,608,607 | 3/1997 | Dittmer | 439/737 |
| 5,625,534 | 4/1997 | Okaya et al. | 439/737 |
| 5,627,416 | 5/1997 | Kantner | 361/684 |
| 5,643,001 | 7/1997 | Kaufman et al. | 439/159 |
| 5,716,221 | 2/1998 | Kantner | 439/64 |

*Primary Examiner*—Renee S. Luebke
*Assistant Examiner*—T. C. Patel
*Attorney, Agent, or Firm*—Thomas L. Peterson

[57] ABSTRACT

A new host (14) and new PC card (12) are provided that have more than the standard two rows (16,18) of 34 contact positions each, where the new host can not only engage the new card but can also engage types I, II, and III standard PCMCIA cards so the new host is backward compatible to the large number of existing standard cards. The new PC card has the standard two rows (16,18) of 34 contact positions vertically spaced by 1¼ mm and has third and fourth additional rows (20,22) of card contact positions vertically spaced from the standard rows. The new card front end has laterally opposite card sides forming runners (44,48) of the standard thickness of about 3.3 mm, with the runners having upper and lower surfaces (72,74) lying respectively above and below the standard pair of rows, and with at least the third row lying above the level of the upper runner surfaces. The new host is similarly constructed with side runner guides (50,52) that guide the runners of the previous standard cards as well as of the new card, with the standard rows of host contacts being similarly positioned, and with the additional rows of host contacts lying above the runner guide upper surfaces. The third row (20) is preferably spaced (J) from the axes of one of the standard rows by more than the vertical spacing (F) of the axes of the two standard rows from each other.

14 Claims, 3 Drawing Sheets

12
14
10
16
18
20
22
30
32
34
36
40
42
44
46
50
52
54
56
60
62
64
A
B
3
4
U
D
R
L
F

MULTI-CONTACT PC CARD AND HOST SYSTEM

BACKGROUND OF THE INVENTION

At present, there are three types of PC cards whose standards are specified by PCMCIA (Personal Computer Memory Card International Association). All three standard cards have two rows of 34 contact positions each, for a total of 68 contact positions. (Not all card contact positions may include a contact, but each position can hold a contact.) All cards have the same width and length (54 mm×85.60 mm) but have different thicknesses in their substrate areas where integrated circuit components may lie. The maximum thicknesses of types I, II, and III are 3.3 mm, 5 mm and 10.5 mm. The type II card is the most popular.

The bus bit architecture of PC cards has been increasing over the last several years from 16 bit to 32 bit architectures, with current proposals to increase to a 64 bit architecture, and with increases in the data rate of signals passing through the contacts. As the data rate increases much above 10 MHz and over 100 MHz, steps have to be taken to provide EMI isolation, as to prevent cross-talk between adjacent signal contacts and to prevent the pick-up and transmission of signals between the card contacts and circuitry in a host. One step has been to add a cardbus shield, which includes a metal plate lying at the top of the front connector and connectable to a secondary ground of the card circuit board. A secondary ground is usually of the same nominal potential as a primary ground, but is isolated therefrom so signals picked up by a large area sheet metal card cover are not coupled to the signal contacts of the front connector. However, at higher data rates, it is found that many separate grounds are required for numerous ones of the contacts. With a 64 bit architecture using 64 bits just for basic signal transmission and the four remaining contacts for power and sensing functions, there are not enough contacts to provide separate grounds for many different signal contacts, even with the cardbus shield in place.

One solution is to provide a new PC card with one or two additional rows of contacts, such as four rows of 34 contact positions each, for a total of 136 contact positions. Of course, a new size host with four rows of contacts would be required to fully receive the new PC card. Because of the large number of existing PC standard cards, especially type II standard cards, a host is still required for such cards. If two separate hosts are to be provided on a compact electronic device such as a personal or laptop computer, then this results in the disadvantage that a lot more volume of the electronic device and a lot more of the surface area of the electronic device is taken up with PC card hosts. A new host for receiving a new card with at least three rows of contact positions, where the new host and new card were constructed so the new host was backward compatible to receive present PC standard cards, especially type II cards, and preferably the other two types as well, would be of value.

SUMMARY OF THE INVENTION

In accordance with one embodiment of the present invention, a new PC card with at least three rows of contact positions and a new host with corresponding rows of contacts are provided, wherein the card and host are constructed so the host is backward compatible to engage at least type II PCMCIA standard cards in addition to the new card. The new host has runner guides for engaging the side runners of a PC card and has a pair of standard rows of contacts that lie between the top and bottom surfaces of the runner guides, to engage a type II card. The host also has at least one additional row of contacts that lie above the level of the upper surface of the runner guides. As a result, when a type II card is inserted into the new host, it is guided so its standard row of card contacts engage the standard row of host contacts, with the front connector of the card being out of contact with the third row of host contacts. The new card includes a pair of runners at its opposite sides, which are substantially identical to those of a standard PC card, and with the new card front connector having a standard pair of rows of contact positions and also having at least one additional row. The additional row may be vertically spaced from an adjacent standard row by a greater distance than the spacing of the two standard rows of contacts from each other.

The novel features of the invention are set forth with particularity in the appended claims. The invention will be best understood from the following description when read in conjunction with the accompanying drawings.

DESCRIPTION OF THE PREFERRED EMBODIMENTS

Figures 1, 2:
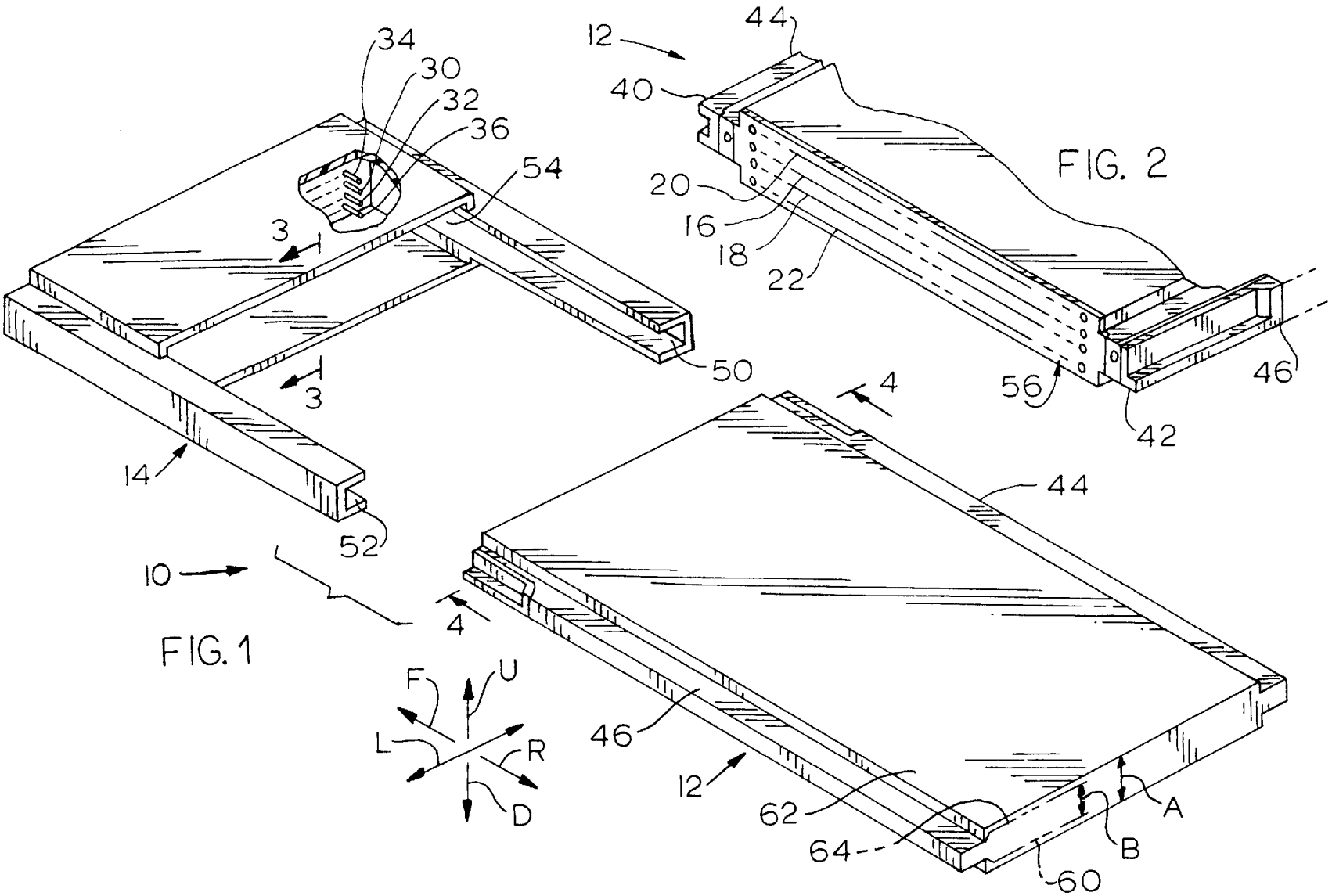
FIG. 1 is an exploded isometric view of a new card and new host of the present invention, and also showing, in phantom lines, a prior art standard type II card.
FIG. 2 is a front isometric view of the front portion of the new card of FIG. 1.

FIG. 1 shows a new PC card and host system 10 which includes a new PC card 12 and a new PC host 14. As shown in FIG. 2, the new card 12 has the standard pair of rows 16, 18 of 34 contacts positions each, that are present in all three types of PCMCIA standard cards (present types I, II, and III). The new card has first and second additional rows 20, 22 of contact positions, with each of the additional rows also having 34 contact positions. The result is that the new card has 136 contact positions. As discussed earlier herein, there are plans to adopt a 64-bit architecture so that 64 bits would be required for each byte of information, with the remaining four contact positions being insufficient. This has led to the discussion of a need for a PC card with more than 68 contacts. The present invention is directed to a new card and new host that provide more than 68 contact positions, and with the new host being backward compatible so it can fully engage prior standard (type I, II, and II) PC cards to enable a single host to receive both the new card and prior standard cards.

The new host 14 (FIG. 1) has a standard pair of rows 30, 32 of contacts, which are designed to engage the standard pair of rows 16, 18 of the new card 12 as well as the standard pair of rows of contacts of a previous (types I, II, or III) PCMCIA standard card. The new host has first and second additional rows 34, 36 of contacts for engaging contacts in the additional rows 20, 22 of the new card. The new card has opposite card sides 40, 42 that form runners 44, 46. The new host has a pair of runner guides 50, 52 that are designed to receive the card runners as the card is moved in a forward direction F into the host, with a forward end portion 54 of each runner guide closely receiving a corresponding card runner to closely position the card runner so the card contacts of a new PC card front connector 56 engage the host contacts.

Figure 4:
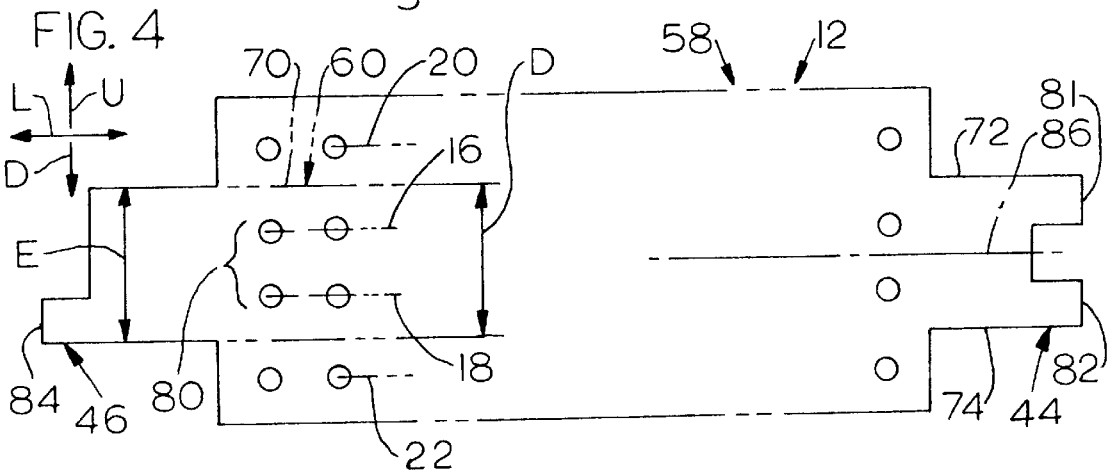
FIG. 4 is a sectional view of the new card of FIG. 1, taken on line 44 of FIG. 1, and also indicating, in phantom lines, a prior art type II card.

FIG. 1, shows, in phantom lines, a type II PCMCIA standard card 60. The card runners 44, 46 are identical in height (in vertical directions U, V) with those of the new card 12, so the runners of the prior card 60 can fit into the runner guides 50, 52 of the new host. However, the substrate areas 62, 64 of the new card 12 and prior card 60 are of different thicknesses or heights A, B. The prior type II card 60 has a maximum height B of 5 mm in a substrate area 64, while the present card has a height A of about 6.5 mm in its substrate area. FIG. 4 shows the shape of the new front connector 58 of the new PC card 12 and shows, in phantom lines, the shape of the front connector 70 of the prior type II card 60. As mentioned above, the runners 44, 46 are of the same height and lateral (L) spacing for the prior card and the new card. Although the substrate area of the prior standard card has a maximum height of 5 mm, the front connector 70 of the prior standard card has a height D of about 3.3 mm along a length of 10 mm at the extreme front end of the card (and forward of the substrate area of the prior card). The runners have upper and lower surfaces 72, 74 that also are spaced by a distance E of about 3.3 mm. The standard pair 80 of rows 16, 18 of card contact positions lie vertically between the upper and lower runner surfaces 72, 74. It is noted that the front of each runner has keys 81, 82, 84 (FIG. 4) that prevent the card from being inserted upside down and that can indicate whether the circuitry in the card is intended for high or for low voltage and for high or low current. A centerline 86 lies halfway between the standard pair of 16, 18 of contact row positions.

FIG. 4 shows that applicant's additional rows of card contact positions 20, 22 are positioned respectively above and below the standard pair 80. The additional rows 20, 22 lie sufficiently above and below the prior card connector 70 that there is considerable clearance between the top and bottom of the prior connector 70 and each of the additional rows 20, 22. As a result, when a prior card connector 70 is inserted into the new host 14 (FIG. 5) the runner guides 50, 52 of the new host position the prior standard cards so the standard pair of rows 16, 18 of the prior connector will accurately engage the standard pair of rows 30, 32 of the new host connector. Also, the placement of the additional rows 34, 36 of the new host results in no interference between the prior card front connector 70 and the additional rows 34, 36 of host contacts.

Figure 3:
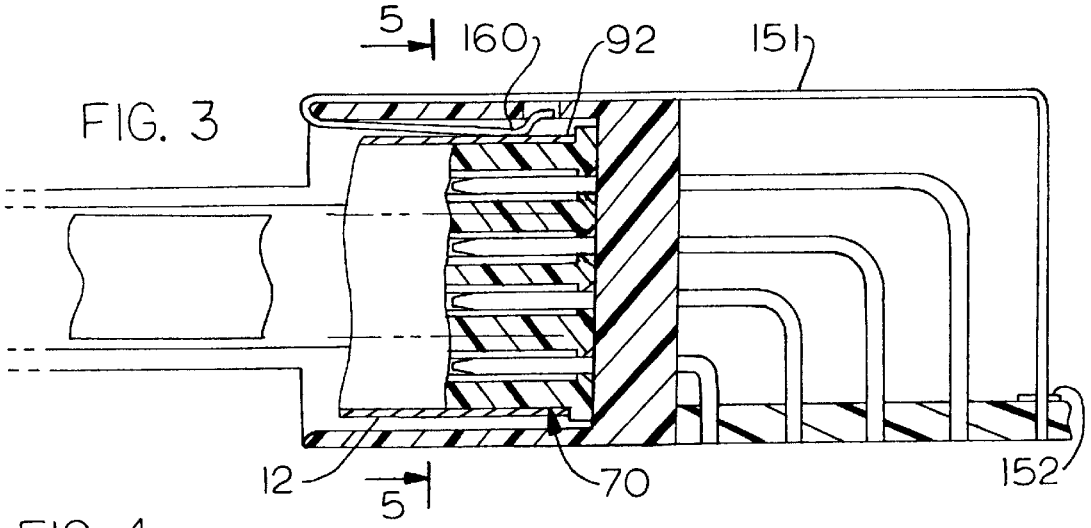
FIG. 3 is a sectional view taken on line 3—3 of FIG. 1, showing the new card fully installed in the new host.
Figure 5:
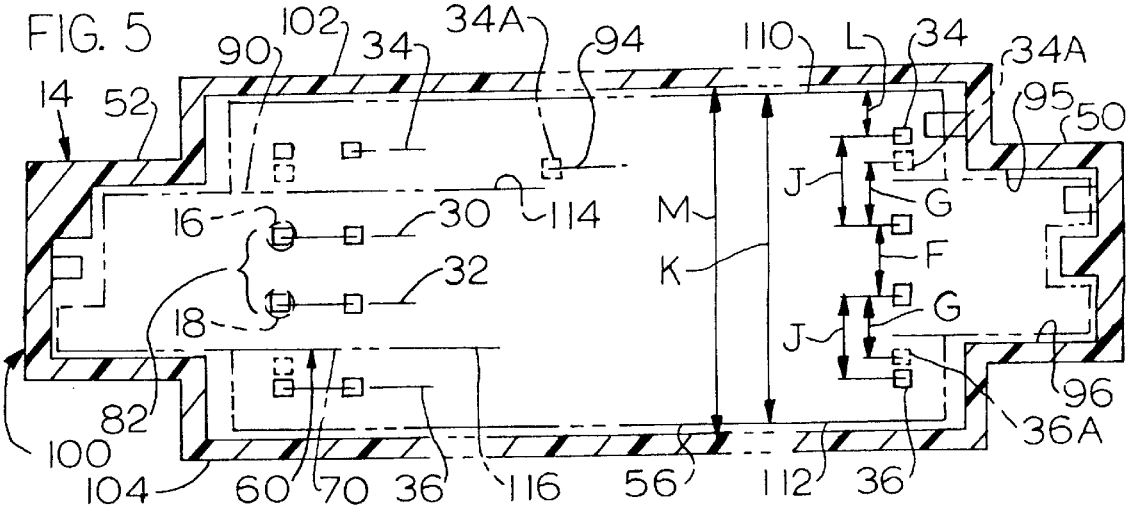
FIG. 5 is a sectional view of the host of FIG. 3, taken on line 5—5 thereof, and also showing, in phantom lines, the new PC card of FIG. 4 installed in the host, and also showing, in phantom lines, a type II PC card installed in the host.

The vertical pitch, or center-to-center spacing F' of the two standard pair of rows of the card and host is 1.25 mm (with tolerances allowed). It would be possible to locate each additional row of host contacts at 34A and 36A, wherein the pitch G was the same as F. However, this would result in the additional rows of contacts such as 34A lying close to the top 90 of the prior card 60. Although the height of the prior art connector 70 is about 3.3 mm, the height of the front end of the prior card 60 varies. For example, the prior card (and the new card) have a sheet metal cover which extends over most of the card, including most of the front connector 70. FIG. 3 shows a sheet metal top cover part 92 lying at the top of the new front connector 70. Sometimes, however, the lateral middle of the cover part 92 bends upwardly, commonly referred to as "smiling". This can cause the middle of the top cover part 92 lying over the front connector to increase the effective height of the prior front connector. FIG. 5 shows the middle 94 of the prior front connector cover part in a bent-up or "smiling" position. This can result in interference with an additional row of contacts at 34A. To avoid this, applicant provides a center-to-center spacing or pitch J between the first additional row of contacts 34 and an adjacent one 30 of the standard pair of contacts 82 which is preferably greater than the pitch F of the standard pair. In the particular connector shown in FIG. 5, the spacing J is 1.5 mm, which provides an additional ¼ mm clearance to prevent interference with the top of the prior art card front end.

The new host 14 includes a housing 100 that forms the runner guides 50, 52 with upper and lower guide surfaces 95, 96. The housing also forms top and bottom host flanges 102, 104 that lie respectively above and below the new card front connector 56. To prevent interference with a prior card front connector 70 and to keep the overall height K of the new card as small as possible, applicant avoids any flanges between the top and bottom flanges 102, 104 of the new host housing 100.

In a connector system of the construction indicated in FIG. 5 that applicant has designed, a standard pitch F of 1.25 mm was maintained between the standard pair of rows 30, 32 of host contacts. The additional rows 34, 36 were spaced by a distance J of 1.5 mm from the pair. A distance L of 1.11 mm was established between the centers of the additional rows and the top and bottom surfaces 110, 112 of the card. This distance L is the same as the distance between each standard row 16, 18 of card contacts and the top and bottom surfaces 114, 116 of the prior card front connector 70. This results in the overall height K of the new card being 6.47 mm (with the usual tolerances used for the prior card). As a result, the new card has a height that is only about 1.5 mm greater than the height of a prior card in its substrate area. It is noted that the height M between the top and bottom flanges of the new host, which is about 6.55 mm, is about 3.1 mm greater than the height of a prior host because a prior host was only tall enough to receive the front connector, and usually did not directly receive the substrate area of the card. FIG. 5 shows switches for detecting the voltage and current capability of the card, as is described in U.S. Pat. No. 5,773,901.

Figure 6:
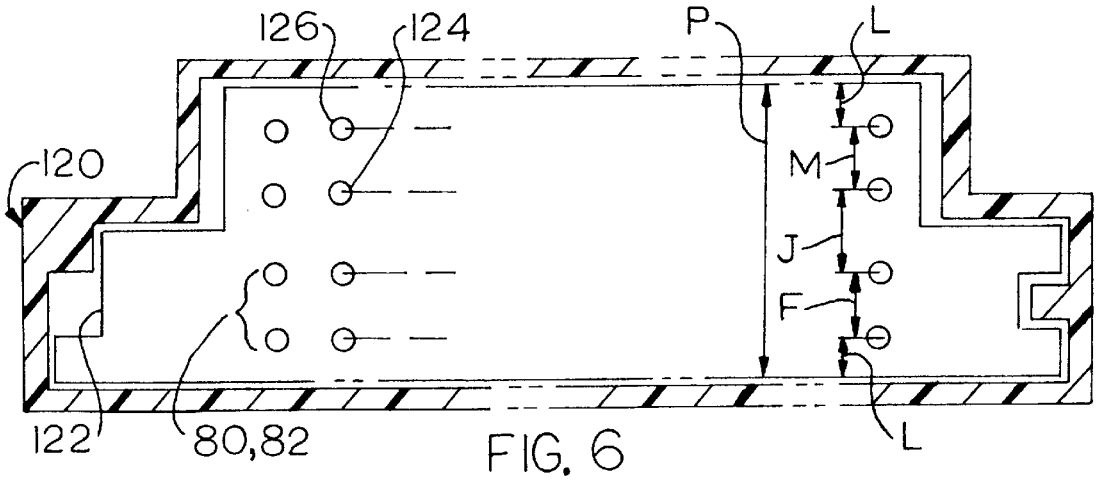
FIG. 6 is a sectional view similar to that of FIG. 5, showing a new host and new card constructed in accordance with another embodiment of the invention.

FIG. 6 illustrates a new host 120 and new card 122 constructed in accordance with another embodiment of the invention, wherein first and second additional rows of contacts 124,126, both lie above the standard pairs of contacts 80, 82, instead of one additional row lying above and the other additional row lying below the standard pair of rows. The pitch F between the standard rows, and the pitch J between a standard row and adjacent first additional row 124 are the same as in FIG. 5. However, the pitch M between two additional rows 124, 126 is the same (1¼ mm) as the spacing between the standard pairs of rows 80, 82. The same spacing L is used at the top and bottom of the card connector. As the result of the closer spacing M between the additional rows 124, 126, the overall height P of the new card is reduced by 0.25 mm (e.g. 6.25 mm instead of 6.5 mm).

Figure 7:
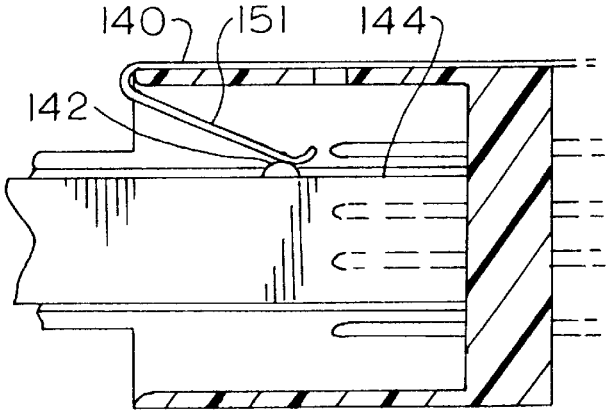
FIG. 7 is a sectional view of the area shown in FIG. 3, with a type II card inserted into the host, where the type II card has a cardbus shield.
Figure 8:
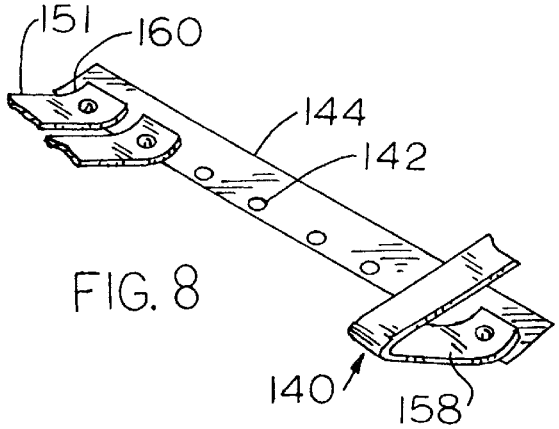
FIG. 8 is a partial isometric view of the grounding device of FIGS. 3 and 7, shown engaging the cardbus shield of FIG. 7.

FIGS. 7 and 8 show the way in which a grounding device 140 engages 0.5 mm high dimples 142 on a cardbus shield 144. A cardbus shield with eight dimples has been adopted by the industry. Applicant's grounding device 140 is provided with eight fingers 151–158, with each finger engaging one of the dimples 142. As shown in FIG. 3, each finger such as 151 extends to a secondary ground plane 152 on a circuit board 154. In FIG. 3, the new card 12 is shown inserted into the host, with the ends 160 of the spring fingers having been deflected further upwardly. The spring fingers have sufficient resilience to also engage the dimples of the cardbus shield as shown in FIG. 7. FIG. 3 shows that the ends 160 of the spring fingers can also engage the sheet metal top part 92 of the new card.

It should be noted that the front connectors of all three standard card types (types I, II, and III) are of the same size, so all three prior cards can fit into the new host 14 of the present invention.

While terms such as "top" "bottom", etc. have been used to help describe the invention as it is illustrated in the drawings, the new and standard prior cards and new host can be used in any orientation with respect to the Earth.

Thus, the invention provides a new card host that can receive a new card having more than two rows of contacts as well as being backward compatible to receive standard PCMCIA cards, especially the common type II card and preferably also the other standard cards (types I and II). The new host has a standard pair of host contacts that have the same vertical (and horizontal) pitch as present hosts, and that have runner guides of the same size and separation as present hosts. However the new host has at least one and preferably two additional or extra rows of contacts that are spaced from the standard pair of contacts, without any host housing flange between the standard and additional rows of host contacts. The new card has a standard pair of card contacts and a standard pair of card runners at its opposite sides, and also has at least one additional row of contacts vertically spaced from the standard pair. The additional pair of contacts are preferably spaced by slightly more (0 to 1 mm) than present spacing, from an adjacent row of the standard pair of rows, to avoid interference with a prior card. The additional rows can both lie above (or below) the standard pair of rows.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A combination of a new PC card with more than 68 contact positions and a PC card-receiving new host where the new host is designed to engage at least a Type II PCMCIA standard card, where said Type II standard card has a front connector with a standard pair of vertically-spaced and laterally-extending rows of 34 card contact positions each for a total of 68 card contact positions and where said Type II standard card has laterally opposite card sides forming runners each of a first thickness of about 3.3 mm with upper and lower runner surfaces lying respectively above and below said standard pair of rows and said Type II standard card has a front middle having a second thickness of about 3.3 mm, wherein:

said new PC card has a new card front connector with at least three vertically-spaced rows of card contact positions, including said standard pair of rows of card contact positions and a third row of card contact positions that is vertically spaced from said standard pair of rows of card contact positions, and said new card has laterally opposite card sides forming only a single runner at each of said sides of said new card, with each of said runners of said new card being of said first thickness of about 3.3 mm each and having upper and lower new runner surfaces lying respectively above and below said standard pair of rows of card contact positions, and with card contact positions in said third row lying above said upper new runner surface;

said new host has a standard pair of rows of host contacts corresponding to said standard pair of contact positions and has opposite side guides that are constructed to guide said runners of said new card so card contact positions lying in said standard pair of rows of card contacts of said new card engage host contacts lying in said standard pair of rows of said host contacts, said new host having a third row of host contacts positioned to engage card contacts in said third row of card contact positions, whereby said new host is compatible to receive Type II PCMCIA cards as well as said new card with more than 68 contact positions.

2. The combination described in claim 1 wherein:

said standard pair of rows of card contact positions have centers that are vertically spaced by a predetermined first pitch distance (F') of 1.25 mm while said third row of card contacts have centers that are vertically spaced from the closest of said standard pair of rows of card contacts by a second pitch distance (G, J) that is not more than 1 mm greater than said first pitch distance.

3. The combination described in claim 1 wherein:

said new PC card has a fourth row of card contact positions lying below said lower new runner surface.

4. A new PC card that can fit into a new host that is backward compatible to also receive at least Type II PCMCIA standard cards by having host guides for engaging standard runners at the opposite sides of the Type II standard card and by having host contacts for a standard pair of vertically-spaced rows of contact positions at the front of the Type II standard card, comprising:

a new card front connector which includes a standard pair of vertically spaced rows of 34 card contact positions each, which have centers spaced by 1¼ mm;

said new card has a housing with opposite card sides forming runners for sliding along said host guides, with said runners positioning said standard pair of rows of card contact positions to engage said host contacts;

said new card front connector has at least a first additional row of contact positions which have centers that are vertically spaced from the centers of one of said standard pair of rows of 34 card contacts by no more than 2 mm.

5. The new PC card described in claim 4 wherein:

said new card has a fourth row of card contacts and the total height of said front card connector is no more than 8 millimeters.

6. The new PC card described in claim 4 including said new host, and wherein:

said new host has a standard pair of host contacts, and also includes an additional row of host contacts that is vertically spaced from an adjacent one of said standard pair of host contacts, with said host being free of a flange or other barrier between said standard pair of host contacts and said additional row of host contacts.

7. The new PC card described in claim 4 including:

a second additional row of card contact positions, with said first and second additional rows both lying above said standard pair of rows of card contact positions, with said first additional row being lowermost of said additional rows and with the vertical distance between centers of said first and second additional rows being less than the vertical distance between centers of said first additional row and centers of an adjacent one of said standard pair of rows of card contact positions.

8. A PC card-receiving new host that is designed to receive at least a Type II PCMCIA standard card, comprising:

a host housing that includes a pair of laterally spaced guide walls forming parallel runner guides with top and bottom guide surfaces, where each runner guide has a height of about 3.5 mm, with said guide walls having outer walls laterally spaced by about 57 mm to closely guide the side edges of said Type II standard card, with said host housing having a standard pair of horizontal rows of host contacts, with said standard pair of rows of host contacts having row centers vertically spaced by 1¼ mm and with said pair of rows of host contacts being vertically and horizontally centered on an imaginary centerline that lies halfway between the top and bottom of said runner guides;

an additional horizontal row of host contacts with centers that are vertically spaced by a predetermined vertical distance from the center of an adjacent one of said standard pair of host contacts, with the vertical pitch distance between said additional row and said adjacent one of said standard pair of host contacts being at least 1.25 mm but no more than 2.25 mm.

9. The new host described in claim 8 wherein:

said predetermined vertical distance is greater than said vertical spacing of 1¼ mm between said row centers of said standard pair of host contacts.

10. The new host described in claim 8 wherein:

said host has a housing with top and bottom flanges, and said standard pair of rows of host contacts and said additional row of host contacts all lie between said top and bottom flanges, with said host being devoid of an extra flange between said top and bottom flanges.

11. The new host described in claim 8 including:

first and second extra rows of host contacts, with said first extra row forming said additional horizontal row of host contacts, with said first and second extra rows both lying above said standard pair of rows of host contacts, and with said first extra row being lowermost with the vertical distance between said first and second extra rows being less than the distance between said first row and an adjacent one of said standard pair of rows of host contacts.

12. A new PC card with more than 68 contact positions, wherein:

said new PC card has a new card front connector with at least three vertically-spaced rows of card contact positions, including a standard pair of rows of card contact positions that are vertically spaced by a first distance according to PCMCIA standards, and a third row of card contact positions that is vertically spaced from said standard pair of rows of card contact positions, and said new card has laterally opposite card sides forming only a single runner at each of said card sides, with said runners each being of a thickness of about 3.3 mm each and having upper and lower runner surfaces lying respectively above and below said standard pair of rows of card contact positions, and with card contact positions in said third row lying above said upper runner surfaces.

13. The new PC card described in claim 12 wherein:

the vertical distance between said third row and said standard pair of rows is no more than 1 mm greater than the vertical distance between said standard pair of rows.

14. The new PC card described in claim 13 wherein:

the vertical distance between said third row and said adjacent one of standard pair of rows is greater than the vertical distance between said standard pair of rows.

* * * * *